US012025310B2

(12) United States Patent
Gralki et al.

(10) Patent No.: US 12,025,310 B2
(45) Date of Patent: Jul. 2, 2024

(54) CERAMIC RESONATOR FOR COMBUSTION CHAMBER SYSTEMS AND COMBUSTION CHAMBER SYSTEM

(71) Applicant: Siemens Energy Global GmbH & Co. KG, Bayern (DE)

(72) Inventors: Matthias Gralki, Mulheim an der Ruhr (DE); Claus Krusch, Essen (DE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 17/788,905

(22) PCT Filed: Dec. 10, 2020

(86) PCT No.: PCT/EP2020/085479

§ 371 (c)(1),
(2) Date: Jun. 24, 2022

(87) PCT Pub. No.: WO2021/139958

PCT Pub. Date: Jul. 15, 2021

(65) Prior Publication Data

US 2023/0041092 A1 Feb. 9, 2023

(30) Foreign Application Priority Data

Jan. 9, 2020 (DE) ..... 10 2020 200 204.5

(51) Int. Cl.
*F23R 3/00* (2006.01)

(52) U.S. Cl.
CPC .... *F23R 3/007* (2013.01); *F23R 2900/00014* (2013.01)

(58) Field of Classification Search
CPC ..... F23R 3/007; F23R 2900/00014; F05D 2260/96; F05D 2260/963; F05D 2260/964;
(Continued)

(56) References Cited

U.S. PATENT DOCUMENTS 7,076,956 B2 * 7/2006 Young ..... F23M 20/005 60/725
7,080,514 B2 7/2006 Bland et al.
(Continued)

FOREIGN PATENT DOCUMENTS

DE 102019204746 A1 10/2020
EP 3438540 A1 2/2019
(Continued)

OTHER PUBLICATIONS

PCT International Search Report and Written Opinion of International Searching Authority dated Mar. 9, 2021 corresponding to PCT International Application No. PCT/EP2020/085479 filed Dec. 10, 2020.

*Primary Examiner* — Todd E Manahan
*Assistant Examiner* — Sean V Meiller
(74) *Attorney, Agent, or Firm* — Wolter Van Dyke Davis, PLLC

(57) ABSTRACT

A ceramic resonator for combustion chamber systems and combustion chamber system, wherein the resonator is annular when seen in the axial throughflow direction and has cavities in the interior, the cavities having at least one resonator neck per cavity as a connection to the inner surface of the ceramic resonator. By using a ceramic resonator, the amount of cooling air required is significantly reduced.

14 Claims, 2 Drawing Sheets

(58) Field of Classification Search
CPC ..... F01N 1/02; F01N 1/03; F02C 7/24; F02C 7/045
See application file for complete search history.

(56) References Cited

U.S. PATENT DOCUMENTS

| | | | | |
|---|---|---|---|---|
| 7,089,741 | B2 * | 8/2006 | Ikeda | F23R 3/002 60/725 |
| 7,984,787 | B2 * | 7/2011 | Liu | F01D 5/143 181/290 |
| 9,097,179 | B2 * | 8/2015 | Brooks | F01D 5/26 |
| 9,163,837 | B2 * | 10/2015 | Sutcu | F23R 3/26 |
| 9,310,079 | B2 * | 4/2016 | Uskert | F23R 3/06 |
| 9,353,648 | B2 * | 5/2016 | Porte | B64D 33/02 |
| 10,145,561 | B2 * | 12/2018 | Stoia | F02C 3/04 |
| 2012/0167574 | A1 | 7/2012 | Uskert | |
| 2018/0166058 | A1 * | 6/2018 | Delehouze | F02K 1/827 |
| 2018/0258857 | A1 | 9/2018 | Prasad et al. | |
| 2020/0200390 | A1 | 6/2020 | Lundgren et al. | |
| 2020/0217332 | A1 * | 7/2020 | Mohr | F04D 29/66 |

FOREIGN PATENT DOCUMENTS

| | | | |
|---|---|---|---|
| EP | 3674081 | A1 | 7/2020 |
| WO | 2010149420 | A1 | 12/2010 |
| WO | 2018021996 | A1 | 2/2018 |
| WO | 2020212039 | A1 | 10/2020 |

* cited by examiner

CERAMIC RESONATOR FOR COMBUSTION CHAMBER SYSTEMS AND COMBUSTION CHAMBER SYSTEM

CROSS REFERENCE TO RELATED APPLICATIONS

This application is the US National Stage of International Application No. PCT/EP2020/085479 filed 10 Dec. 2020, and claims the benefit thereof. The International Application claims the benefit of German Application No. DE 10 2020 200 204.5 filed 9 Jan. 2020. All of the applications are incorporated by reference herein in their entirety.

FIELD OF INVENTION

The invention relates to a resonator, in particular a Helmholtz resonator, which is used in combustion chambers, in particular in combustion chamber systems of turbines, in particular gas turbines.

BACKGROUND OF INVENTION

Tubular combustion chamber systems of stationary gas turbines generally consist of one or more combustion chamber components connected axially in series between the burner outlet and the turbine inlet. Thus, the tubular combustion chamber types made by Siemens AG have a system consisting of a "basket" and a "transition". This system carries the combustion gases from the burner in the direction of the turbine inlet. Owing to the high combustion temperatures, the tubular combustion chamber components are usually based on thin-walled Ni-based materials with internal cooling ducts and a layer system for thermal insulation (ceramic+metallic bonding layer).

In or downstream of the flame region, the tubular combustion chamber systems have circumferentially arranged resonators in order to reduce acoustic combustion oscillations. The resonator region limits the service life of the respective component ("basket" or "transition"). The production of the resonators is complex and expensive.

The resonator region has relatively large cooling air surfaces and is intensively cooled or flowed through. In this respect, the cooling air requirement is relatively high in relation to the overall tubular combustion chamber system.

SUMMARY OF INVENTION

It is therefore the object of the invention to solve the problem mentioned above.

The object is achieved by a ceramic resonator as claimed and a combustion chamber system as claimed.

The subclaims list further advantageous measures which can be combined with one another as desired in order to achieve further advantages.

BRIEF DESCRIPTION OF THE DRAWINGS

The figures and the description represent only exemplary embodiments of the invention.

More specifically.

DETAILED DESCRIPTION OF INVENTION

The ceramic resonator according to the invention based on the Helmholtz principle replaces a metallic welded construction of a resonator system of a tubular combustion chamber.

The ceramic resonator 1 according to the invention (FIG. 1) is a ceramic component which is of ring-shaped design (oval or circular) or is designed as a one-piece ring, segmented or as a segmented ring, with inner cavities 16', 16", . . . (FIG. 2).

These cavities 16', 16", . . . are open toward the inner surface 7, the hot-gas side, in order to permit damping in accordance with the Helmholtz principle.

Moreover, it is possible to open the cavities 16', 16", . . . also toward the cold-gas side 4, should this be necessary.

The cavities 16', 16", . . . are to be adapted and configured in size, shape, number, distribution and/or resonator necks to match the frequency to be damped. The size, shape, number, distribution and resonator necks can be varied within the ceramic resonator 1.

It is also possible in particular to configure cavities with a plurality of openings toward the hot-gas side.

Advantages:

- reduction of production and life cycle costs by means of a ceramic resonator ring which can be produced at low cost
- reduced high-temperature requirements for the metallic material of the supporting structure
- reduced repair/reprocessing costs as a result of the elimination of decoating and recoating
- increase in maintenance intervals through the avoidance of crack-inducing high temperature gradients in the metallic supporting structure
- reduction of the cooling air requirement in comparison with radial-flow metallic resonators
- transferability to tubular combustion chamber systems from competitors.

Figure 1:
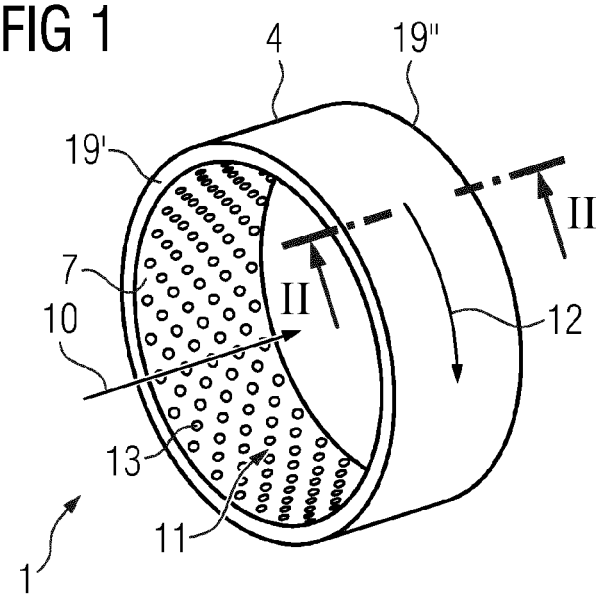
FIG. 1 shows a ceramic resonator.
Figure 2:
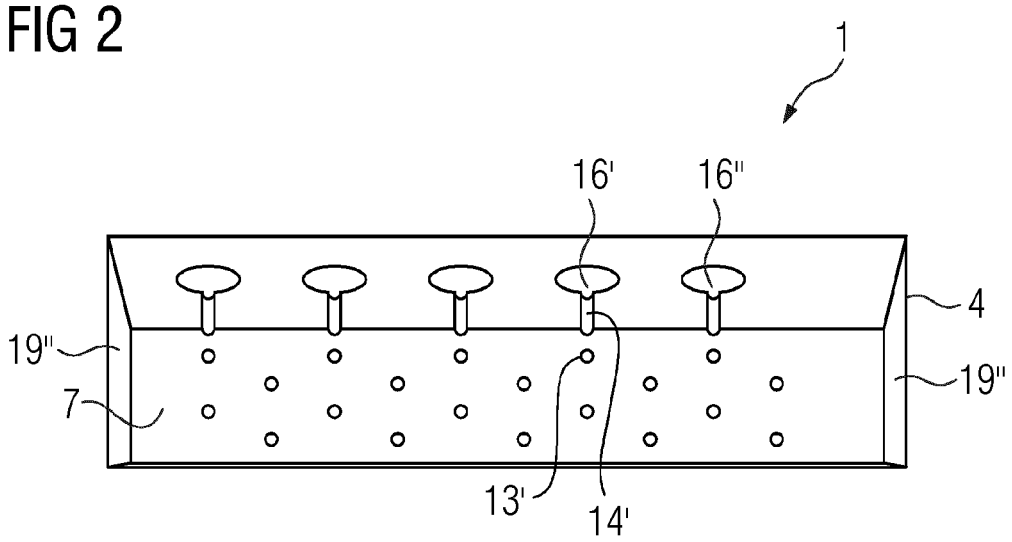
FIG. 2 shows a cross section according to FIG. 1.

FIG. 1 shows a ceramic resonator 1, which is advantageously designed as a ring or in a ring shape with a circular or oval cross section when viewed in the axial direction 10 (throughflow direction).

The ceramic resonator 1 can also be of segmented construction, i.e. can consist of two half-shells or a plurality of segments (neither option being illustrated).

Figure 3:
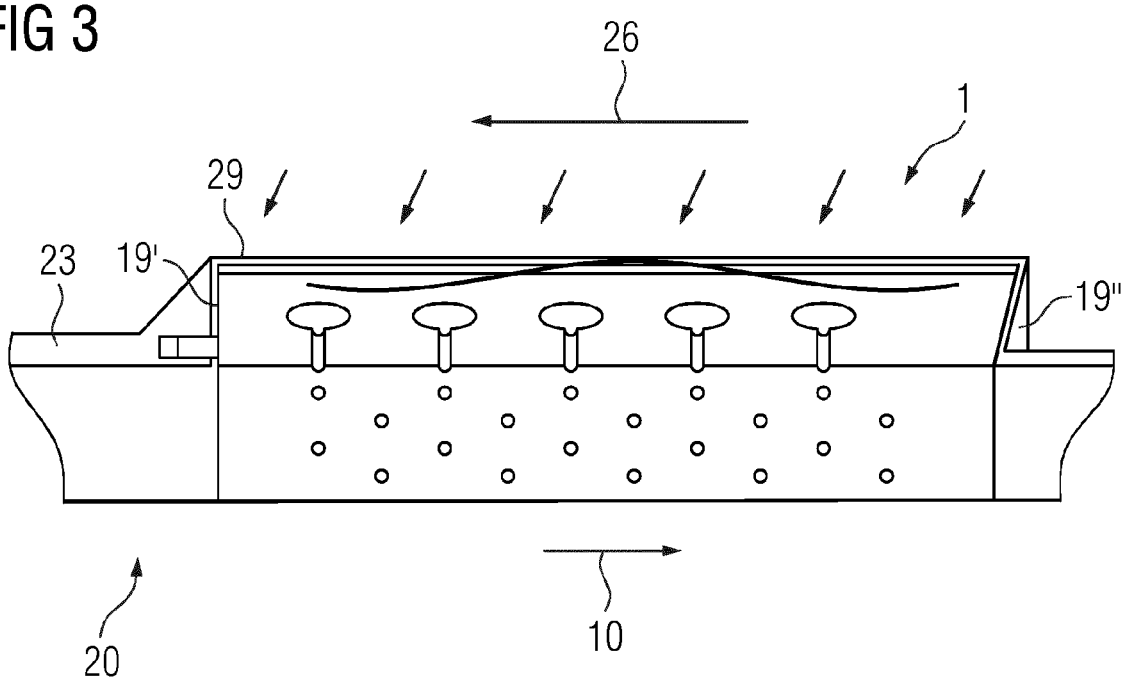
FIG. 3 shows a cross section of the ceramic resonator in the installed state of a combustion chamber system.

The ceramic resonator 1 has an outer surface 4 (cold-gas side) and an inner surface 7 (hot-gas side), openings 13, 13' being present on the inner surface 7 of resonator necks 14', . . . , which project, in particular radially, into the ceramic resonator 1 and open into cavities 16', 16", . . . (FIG. 2, FIG. 3).

The inner surface 7 delimits a hot-gas stream which flows through the ceramic resonator 1 in the axial throughflow direction 10 and with respect to which the ceramic resonator is advantageously concentrically aligned.

FIG. 2, in a section (parallel to the axial throughflow direction 10) according to FIG. 1, shows cavities 16', 16", . . . , which are advantageously spherical and/or oval, cuboidal and/or cube-shaped or have a surface which is curved in some other way and/or has a different type of geometry in respect of its angles and edges.

The geometry of the cavities 16', 16", . . . used can be the same for each ceramic resonator 1, but it may also be varied within the ceramic resonator 1.

Starting from this cavity 16', 16", . . . there is, in particular, just one resonator neck 14', . . . , which ends in an opening 13' on the inner surface 7 of the ceramic resonator 1.

There may also be a plurality of necks per cavity 16', 16", . . . (not illustrated).

The cavities 16', 16", . . . are advantageously arranged uniformly, as illustrated in FIGS. 1 and 2, or in a nonuniformly distributed manner (not illustrated) and advantageously have the same or different geometries in respect of the diameter of the resonator necks 14', . . . , the length of the resonator necks 14', . . . and/or the shape of the cavity 16', 16". Other distributions which are uniformly arranged and differ from the figures are possible.

Here in FIGS. 1 and 2, the cavities 16', 16", . . . are arranged offset in relation to one another and uniformly in the circumferential direction 12.

The side faces 19', 19" of the ceramic resonator) are advantageously designed taper towards each other from the outermost surface toward the innermost surface and/or at right angles to the inner 7 and outer surface 4 in order to allow installation in a combustion chamber system 20 or resonator housing 23 (FIG. 3).

The ceramic resonator 1 is advantageously arranged in a corresponding protrusion 29 as part of a metallic supporting structure 29 of the resonator housing 23 for the ceramic resonator 1 of a combustion chamber system 20 (FIG. 3). The axial flow direction 10 of the hot gas is again illustrated, whereas the direction 26 represents the direction of the cooling air in the opposite direction, starting from the compressor.

The ceramic used for the resonator 1 is advantageously a refractory ceramic, advantageously an $Al_2O_3$ refractory ceramic.

The porosity of the ceramic resonator 1 is advantageously ≥2 vol % and, in particular, ≤20 vol %.

The dimensions of an exemplary ceramic resonator 1 are advantageously: inside diameter 400 mm, thickness 30 . . . 40 mm, length 200 mm.

The invention claimed is:

1. A combustion chamber system, comprising: a ceramic resonator, comprising: a ring-shaped design when seen in an axial throughflow direction that defines an inner perimeter and an outer perimeter, wherein the inner perimeter partly delimits a hot gas flow path, and at least one ceramic body comprising: an innermost surface that constitutes at least part of the inner perimeter; an outermost surface that constitutes at least part of the outer perimeter; an upstream side that connects the outermost surface to the innermost surface: a downstream side that is disposed opposite the upstream side and that connects the outermost surface to the innermost surface: an interior between the outermost surface and the innermost surface; cavities disposed in the interior and set apart from the outermost surface, and at least one resonator neck per cavity as a connection between the innermost surface and a respective cavity, wherein the upstream side and the downstream side taper toward each other from the outermost surface toward the innermost surface and a resonator housing comprising: a housing inner surface that partly delimits the hot gas flow path; and a receptacle that is recessed relative to the housing inner surface; wherein the receptacle is configured to receive the ceramic resonator therein and to position the inner perimeter flush with the housing inner surface.

2. The combustion chamber system as claimed in claim 1,
wherein the at least one ceramic body consists of one ceramic body, and
wherein the one ceramic body defines the ring-shaped design, the inner perimeter, and the outer perimeter.

3. The combustion chamber system as claimed in claim 1,
wherein at least one cavity of the cavities is of spherical design.

4. The combustion chamber system as claimed in claim 1,
wherein at least one cavity of the cavities is of oval design.

5. The combustion chamber system as claimed in claim 1, wherein the cavities comprise:
a plurality of cavities along the axial throughflow direction, and
a plurality of cavities in a radial circumferential direction.

6. The combustion chamber system as claimed in claim 1, wherein the cavities are uniformly distributed in relation to the innermost surface of the at least one ceramic body and are, at least in a region, offset from one another in a circumferential direction.

7. The combustion chamber system as claimed in claim 1,
wherein the ceramic resonator consists only of ceramics, and
wherein the ceramics are limited to refractory ceramics.

8. The combustion chamber system as claimed in claim 1,
wherein a porosity of the at least one ceramic body is ≥2 vol % and in particular ≤20 vol %.

9. The combustion chamber system as claimed in claim 1,
wherein there is only one resonator neck per cavity.

10. The combustion chamber system as claimed in claim 1,
wherein the ceramic resonator has a circular or oval cross section.

11. The combustion chamber system as claimed in claim 1, wherein the receptacle is disposed between an upstream portion of the housing inner surface and a downstream portion of the housing inner surface.

12. The combustion chamber system as claimed in claim 1, wherein the ceramic resonator is disposed between the hot gas flow path therein and a flow of cooling fluid therearound.

13. The combustion chamber system as claimed in claim 12,
wherein the combustion chamber system is configured to direct hot gas through the hot gas flow path in a hot gas flow direction, and
wherein the flow of cooling fluid flows in a direction that is opposite the hot gas flow direction.

14. The combustion chamber system as claimed in claim 1, further comprising:
a combustion chamber and a transition duct disposed downstream of the transition duct;
wherein the ceramic resonator is disposed in the transition duct.

* * * * *